US005388401A

United States Patent [19]

Nishizawa et al.

[11] Patent Number: 5,388,401

[45] Date of Patent: Feb. 14, 1995

[54] SYSTEM AND METHOD FOR CONTROLLING AIR/FUEL MIXTURE RATIO FOR INTERNAL COMBUSTION ENGINE WITH EXHAUST SECONDARY AIR SUPPLY APPARATUS

[75] Inventors: Kimiyoshi Nishizawa, Yokohama; Toru Kamibeppu, Kagoshima, both of Japan

[73] Assignee: Nissan Motor Co., Ltd., Yokohama, Japan

[21] Appl. No.: 101,706

[22] Filed: Aug. 4, 1993

[30] Foreign Application Priority Data

Sep. 10, 1992 [JP] Japan ..... 4-242297

[51] Int. Cl.[6] ..... F01N 3/22

[52] U.S. Cl. ..... 60/274; 60/276; 60/277; 60/289

[58] Field of Search ..... 60/274, 276, 277, 289

[56] References Cited

U.S. PATENT DOCUMENTS 5,113,651 5/1992 Kotzan ..... 60/274
5,119,631 6/1992 Kayanuma ..... 60/289
5,140,810 8/1992 Kuroda ..... 60/277

FOREIGN PATENT DOCUMENTS 63-143362 6/1988 Japan .
63-212750 9/1988 Japan .
63-248908 10/1988 Japan .
1-216011 8/1989 Japan .

OTHER PUBLICATIONS 63-11256 Takayuki Demura, "Self-Diagnosable Control Device For Internal Combustion Engine", Japanese Abstract, (Aug. 1988).

*Primary Examiner*—Douglas Hart
*Attorney, Agent, or Firm*—Foley & Lardner

[57] ABSTRACT

An air/fuel mixture ratio control apparatus for an internal combustion engine which carries out a fault diagnose for a secondary air supply apparatus is disclosed. The secondary air supply apparatus is installed in the engine so as to operatively introduce a secondary air to a part of an engine exhaust gas passage upstream of an oxygen concentration sensor during an engine cold duration. The air/fuel mixture ratio control apparatus compares an updated learning value of the air/fuel mixture ratio stored during the air/fuel mixture ratio feedback control and during the introduction of the secondary air to the exhaust gas passage with the updated learning value of the air/fuel mixture ratio stored during the air/fuel mixture ratio feedback control and during no introduction of the secondary air to the exhaust gas passage so as to diagnose the fault secondary air supply apparatus.

11 Claims, 9 Drawing Sheets

MAP OF PL

SYSTEM AND METHOD FOR CONTROLLING AIR/FUEL MIXTURE RATIO FOR INTERNAL COMBUSTION ENGINE WITH EXHAUST SECONDARY AIR SUPPLY APPARATUS

BACKGROUND OF THE INVENTION (1) Field of the invention

The present invention relates to a system and method for controlling an air/fuel mixture ratio for an internal combustion engine which specially carry out fault diagnoses for a secondary air supply apparatus located in an exhaust gas passage upstream of an oxygen concentration sensor.

(2) Description of the background art

In an exhaust gas passage of an internal combustion engine, a three-way catalytic converter is installed. To improve conversion efficiencies of respective exhaust gas components (CO, HC, and NOx), an air/fuel mixture ratio feedback control is carried out so that an air/fuel mixture ratio on the exhaust gas passing through the catalytic converter falls in a narrow range with a stoichiometric air/fuel mixture ratio as a center. However, in order to improve a driveability of the engine, the air/fuel mixture ratio feedback control is halted.

A case where the driveability of the engine taken into consideration includes an engine cooling situation. In this case, since a fuel combustion is not stable, the air/fuel mixture ratio feedback control is halted and, in place of it, a richer air/fuel mixture ratio with respect to the stoichiometric air/fuel mixture ratio with a correction of the air/fuel mixture ratio has been made to increase the fuel injection quantity according to a temperature of an engine coolant so as to stabilize engine revolutions.

However, the internal combustion engine is often provided with a secondary air supply apparatus to introduce a secondary air to the exhaust gas passage in order to prevent the conversion efficiencies of HC and CO from being reduced when the exhaust gas passing through the catalytic converter installed in a midway through the exhaust gas passage becomes richer air/fuel mixture ratio due to the increased quantity of fuel. Therefore, since the secondary air is introduced into a part of the exhaust gas passage upstream of the oxygen concentration sensor (so-called $O_2$ sensor) so that the exhaust gas is returned to a leaner air/fuel mixture ratio with respect to the stoichiometric air/fuel mixture ratio or near to the stoichiometric air/fuel mixture ratio so as to promote oxidation of HC and CO and so as to increase an exhaust gas temperature by burning an uncombusted HC, thus quickening to activate the catalytic converter.

If, in this case, a failure in the secondary air supply apparatus occurs, the conversion efficiencies of HC and CO can be reduced.

A Japanese Patent Application First Publication No. Showa 63-111256 published on May 16, 1988 exemplifies a previously proposed secondary air supply apparatus failure diagnosing system.

In the above-identified Japanese Patent Application First Publication, a system for controlling air/fuel mixture ratio determines an occurrence in failure in the secondary air supply system when a signal output from the oxygen concentration sensor indicates a richer air/fuel mixture ratio even during the introduction of secondary air to the exhaust gas passage. This is because the failure in the secondary air supply system is caused by a reduced flow quantity of the secondary air from an air pump or by an open/close valve installed in a passage of the secondary air supply apparatus which is stuck to a full closure position or which does not open sufficiently. Consequently, an insufficient quantity of the secondary air is resulted and the exhaust gas provides and maintains the air/fuel mixture ratio at a richer air/fuel mixture ratio.

However, an accuracy of the determination of failure of the secondary air supply apparatus becomes reduced since the oxygen sensor itself outputs the richer air/fuel mixture ratio signal due to the failure in the oxygen concentration sensor in the case of the air/fuel mixture ratio control and secondary air supply failure diagnosing apparatus disclosed in the above-identified Japanese Patent Application First Publication.

For example, when an intake air quantity characteristic becomes deviated toward a larger airflow quantity due to variations in the intake air flow quantity measured by an airflow meter and due to its aging effect and a larger quantity of fuel is injected through a fuel injection valve according to the increased intake air flow quantity, the air/fuel mixture ratio is determined to be richer if it is at the air/fuel mixture ratio feedback control so that the air/fuel mixture ratio feedback control system is operated to decrease a basic fuel injection pulsewidth Tp with the air/fuel mixture ratio feedback correction coefficient. Consequently, the air/fuel mixture ratio does not tend to be directed toward the richer air/fuel mixture ratio.

However, while the secondary air is introduced, the air/fuel mixture ratio feedback control is halted so that the decreasing correction by means of $\alpha$ does not work. Therefore, due to larger quantity of fuel injected through the fuel injection valve accompanied with an erroneous detection of the airflow meter, the air/fuel mixture ratio tends to be directed toward relatively richer side, thus being detected by means of the oxygen concentration sensor.

However, even, at this time, the air/fuel mixture ratio control and secondary air supply apparatus diagnosing systems determine the failure in the secondary air supply apparatus since the output signal of $O_2$ sensor indicates the rich state during the introduction of the secondary air to the exhaust gas passage.

On the contrary, the previously proposed system disclosed in the above-identified Japanese Patent Application First Publication does not determine the failure in the secondary air supply apparatus even when the secondary air supply apparatus actually fails. For example, when the airflow meter detects the intake air quantity less than the actual intake air quantity during, e.g., a transient operating condition or the flow quantity characteristic is maintained at the stoichiometric air/fuel mixture ratio or deviated toward a leaner side even when the flow quantity of the secondary air is appropriate.

SUMMARY OF THE INVENTION

It is, therefore, an object of the present invention to provide a control apparatus for an internal combustion engine in which an accuracy of fault diagnosis for the secondary air supply apparatus can be improved while carrying out a learning of an air/fuel mixture ratio feedback control.

The above-described object can be achieved by providing an apparatus for an internal combustion engine, comprising: a) an oxygen concentration sensor disposed in an exhaust gas passage of the engine upstream of a catalytic converter for detecting and outputting a signal indicative of an air/fuel mixture ratio of the engine; b) a secondary air supply apparatus disposed in the engine and which is constructed so as to supply a secondary air to the exhaust gas passage upstream of said oxygen concentration sensor; c) first means for determining whether said secondary air supply apparatus is operated to supply the secondary air to the exhaust gas passage; d) second means for carrying out an air/fuel mixture ratio of the engine in a feedback control mode on the basis of the signal derived from said oxygen concentration sensor during the supply of the secondary air determined as the result of determination by said first means, deriving a feedback correction coefficient of the air/fuel mixture ratio as the result of the feedback control thereby and updating an ,air/fuel mixture ratio learned value stored in a first memory on the basis of the feedback correction coefficient derived thereby; e) third means for carrying out the air/fuel mixture ratio of the engine in the feedback control mode on the basis of the signal derived from said oxygen concentration sensor during no supply of the secondary air determined as the result of determination by said first means, deriving the feedback correction coefficient of the air/fuel mixture ratio as the result of the feedback control thereby and updating the air/fuel mixture ratio learned value stored in a second memory on the basis of the feedback correction coefficient derived thereby; and f) fourth means for comparing both updated learned values in said first and second memories to carry out a diagnose for the secondary air supply apparatus.

The above-described object can also be achieved by providing a method for diagnosing a secondary air supply apparatus for an internal combustion engine, the internal combustion engine having a) an oxygen concentration sensor disposed in an exhaust gas passage of the engine upstream of a catalytic converter for detecting and outputting a signal indicative of an air/fuel mixture ratio of the engine; and b) the secondary air supply apparatus disposed in the engine and which is constructed so as to supply a secondary air to the exhaust gas passage upstream of said oxygen concentration sensor during a cold interval of time of the engine; the method comprising the steps of: c) determining whether said secondary air supply apparatus is operated to supply the secondary air to the exhaust gas passage; d) carrying out an air/fuel mixture ratio of the engine in a feedback control mode on the basis of the signal derived from said oxygen concentration sensor during the supply of the secondary air determined as the result of determination by said first means, deriving a feedback correction coefficient of the air/fuel mixture ratio as the result of the feedback control therein and updating an air/fuel mixture ratio learning value stored in a first memory on the basis of the feedback correction coefficient derived therein; e) carrying out the air/fuel mixture ratio of the engine in the feedback control mode on the basis of the signal derived from said oxygen concentration sensor during no supply of the secondary air determined as the result of determination by said first means, deriving the feedback correction coefficient of the air/fuel mixture ratio as the result of the feedback control therein and updating the air/fuel mixture ratio learning value stored in a second memory on the basis of the feedback correction coefficient derived therein; and f) comparing both updated values in said first and second memories to carry out the diagnose for the secondary air supply apparatus to deterrmine whether the secondary air supply apparatus has failed.

DETAILED DESCRIPTION OF THE PREFERRED EMBODIMENTS

Reference will hereinafter be made to the drawings in order to facilitate a better understanding of the present invention.

Figure 1:
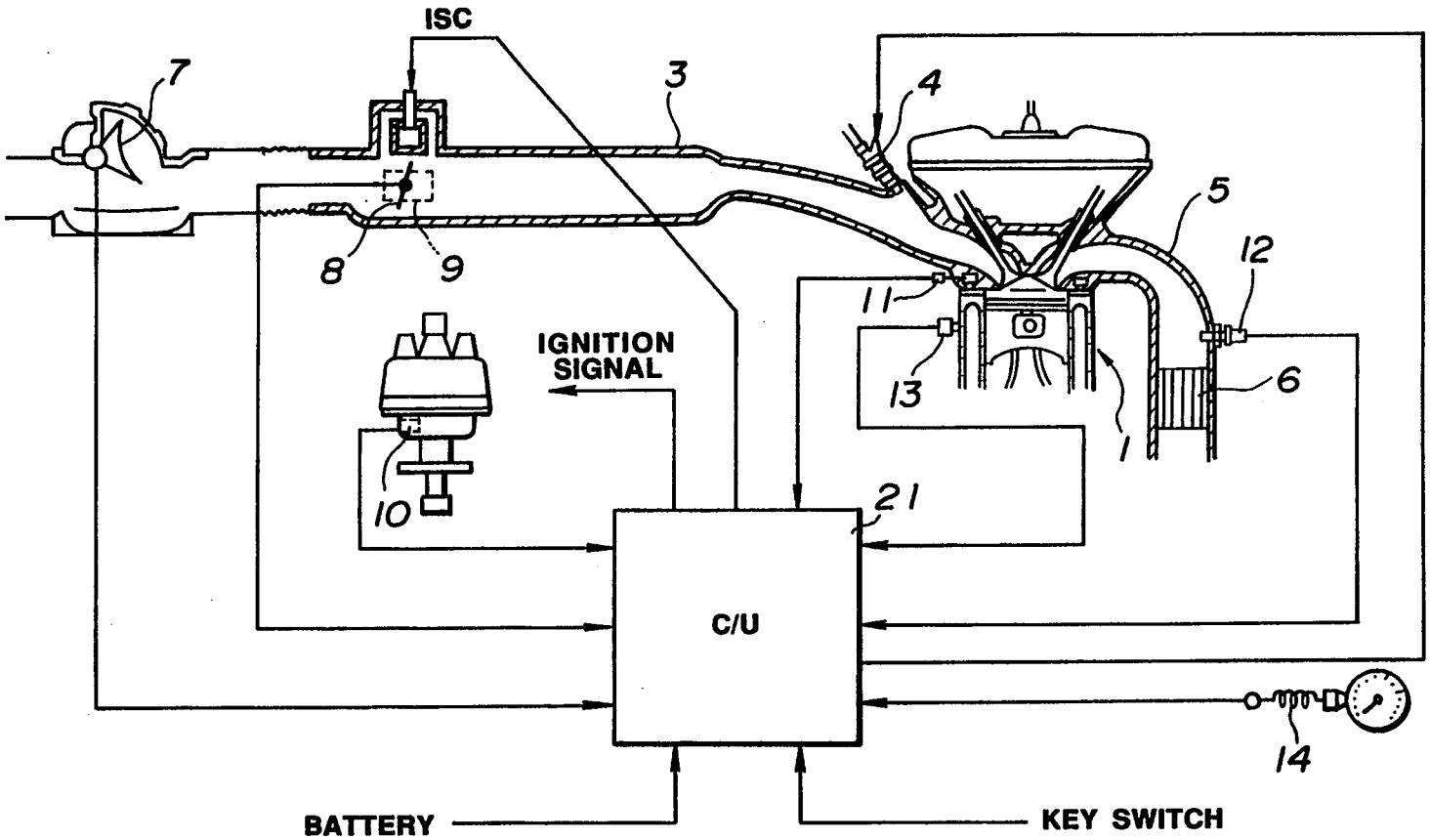
FIG. 1 is a circuit block diagram of a system for controlling air/fuel mixture ratio for an internal combustion engine according to the present invention.

FIG. 1 shows a control apparatus for an internal combustion engine of a preferred embodiment according to the present invention.

In FIG. 1, an airflow meter 7 is installed to detect an intake air quantity Qa sucked from an air cleaner. An idle switch 9 is installed on a throttle valve to detect an idling condition when it is turned off. A signal for each unit of crank angle and a signal (Reference signal) indicating a predetermined crank angle position are output from a crank angle sensor 10. An engine coolant temperature 11 is installed in an engine coolant jacket to detect the coolant temperature.

An oxygen concentration sensor 12 is installed at an upstream of the three-way catalytic converter 6 which has a characteristic such that its output voltage value is acted upon the concentration of oxygen and steeply changed with the stoichiometric air/fuel mixture ratio as a boundary. A knock sensor 13 is installed on the engine body to detect an engine knocking. A vehicle speed sensor 14 is installed in a tire wheel to detect the vehicle speed.

The output signals from those sensors are transmitted to a control unit 21 having a microcomputer.

An injection of fuel is supplied from a single point injection type fuel injection valve 4 installed in an intake air port. A quantity of fuel injected to the engine is in accordance with a pulse duration of time calculated by the control unit 21. If the pulse duration is long, the fuel injection quantity is accordingly increased and vice versa.

A richness of the air/fuel mixture supplied to the engine, i.e., an air/fuel mixture ratio becomes deviated to the richer side when the fuel injection quantity becomes larger with a constant quantity of intake air and becomes deviated to the leaner side when the fuel injection quantity becomes smaller.

Hence, if the basic fuel injection quantity is determined so that the ratio of the intake air quantity becomes constant, the air/fuel mixture of the same air/fuel mixture ratio can be obtained even if the engine driving condition is changed.

When the fuel injection is once carried out per revolution of the engine, the control unit 21 determines a basic fuel injection quantity, i.e., a basic injection pulsewidth Tp per revolution from the outstanding intake air quantity Qa and engine revolution speed Ne ($Tp=K \cdot Qa/Ne$, K denotes a constant). A basic air/fuel mixture ratio determined by the Tp is generally placed in the vicinity to the stoichiometric air/fuel mixture ratio in the air/fuel mixture ratio feedback control region.

An exhaust gas passage (pipe) 5 is provided with the three-way catalytic converter 6 to process three harmful gas components of CO, HC, and $NO_x$.

However, it is noted that to maintain preferable conversion efficiencies of the three harmful components, an atmosphere of the catalysts falls in a narrow range (catalytic window) with the stoichiometric air/fuel mixture ratio as a center. If the-air/fuel mixture ratio is deviated from the stoichiometric air/fuel mixture ratio to the richer side, the conversion efficiencies of CO and HC are deteriorated. If it is deviated toward the leaner side, on the contrary, the conversion efficiencies of $NO_x$ are deteriorated.

Then, since the control unit 21 carries out the feedback correction of the fuel injection quantity on the basis of the output signal of the oxygen concentration sensor 12 so as to maintain an average value of the air/fuel mixture ratio at a position near to the stoichiometric air/fuel mixture ratio on the basis of the output signal of $O_2$ sensor 12.

When the output voltage of the $O_2$ sensor 12 is higher than a slice level corresponding to the stoichiometric air/fuel mixture ratio, the air/fuel mixture ratio is determined to be rich and when is is lower than the slice level, it is determined to be lean.

When the air/fuel mixture ratio is reversed to the rich side according to the result of determination of the air/fuel mixture ratio, the air/fuel mixture ratio needs to be returned to the lean side.

Figure 3:
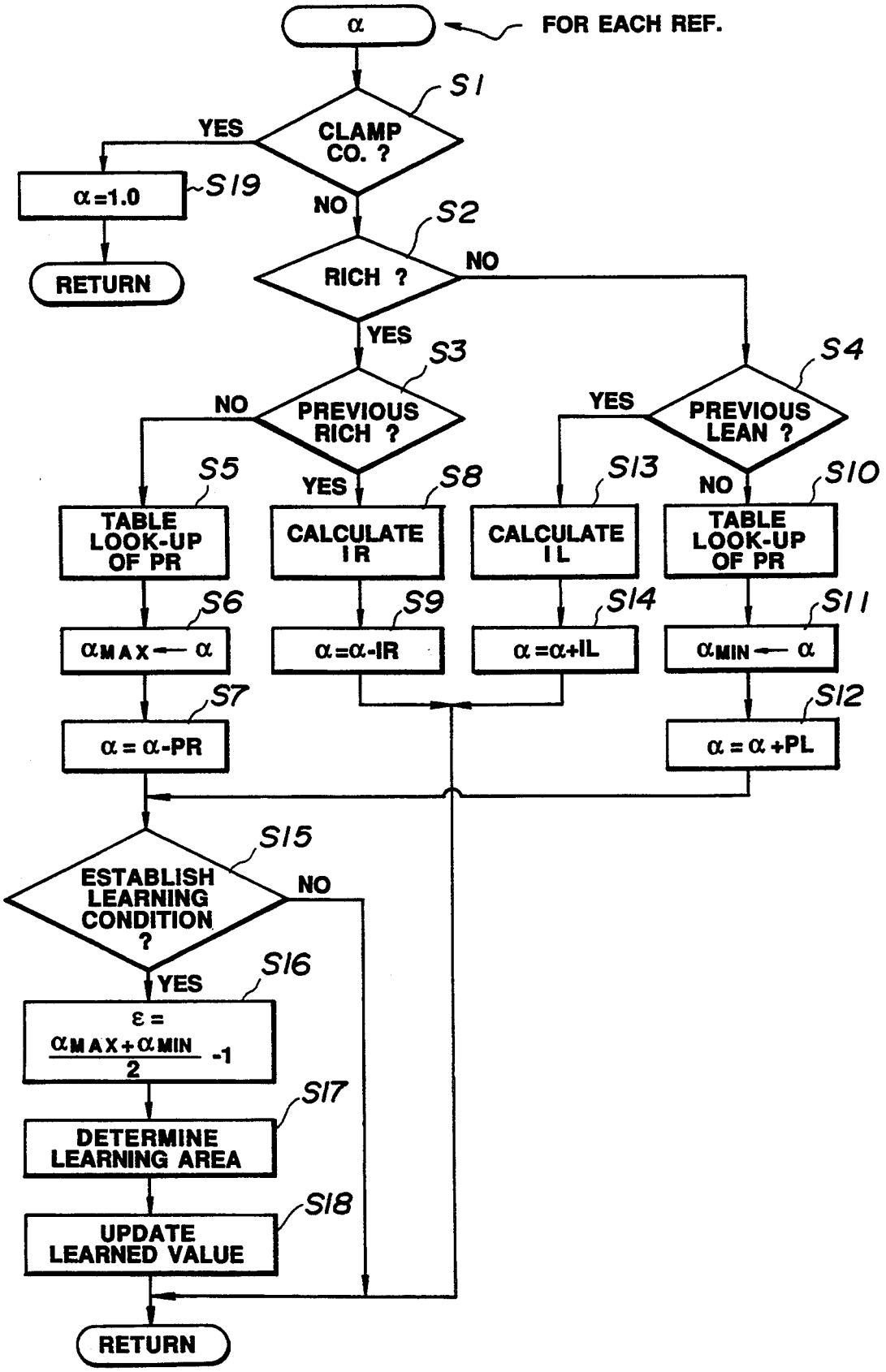
FIG. 3 is an operational flowchart for explaining a calculation of an air/fuel mixture ratio feedback correction coefficient $\alpha$ and updating of an air fuel mixture ratio learned value executed in a preferred embodiment of the system for controlling air/fuel mixture ratio for an internal combustion engine.

As appreciated from an operational flowchart of FIG. 3, immediately after the air/fuel mixture ratio is reversed to the rich side, a step component PR is subtracted from the air/fuel mixture ratio feedback correction coefficient $\alpha$ and an integration component IR is subtracted from $\alpha$ immediately before the reverse of the air/fuel mixture ratio to the next rich side (steps S2, S4, S12 and steps S2, S3, and S9 in FIG. 3)

On the contrary, when the air/fuel mixture ratio is reverse to the lean side, the step component PL is added to $\alpha$ and the integration component IL is added until the actual air/fuel mixture ratio is next reversed to the rich side (steps S2, S4, S12 and steps S2, S4, and S14 of FIG. 3).

It is noted that the calculation of $\alpha$ is synchronized with the reference signal. This is because the fuel injection timing is synchronized with the reference signal (Ref.) and disturbance in the system is also synchronized with the reference signal Ref.

The step components (proportional components) PR, PL are relatively large with respect to the values of integration components IR and IL, respectively.

This is because a large value of the step component may be provided to give a good responsiveness to change to an opposite side immediately after the air/fuel mixture ratio is reversed to the rich side or lean side. The integration components of smaller values may be used to apply to the air/fuel mixture ratio slowly after the additions of the larger step components so that the feedback control may be stable.

Figure 5:
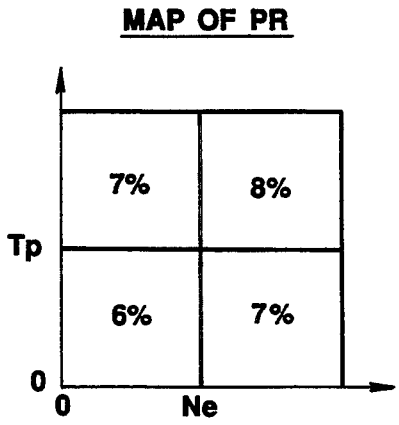
FIG. 5 is a characteristic graph for explaining a map value of a step component of PR.
Figure 6:
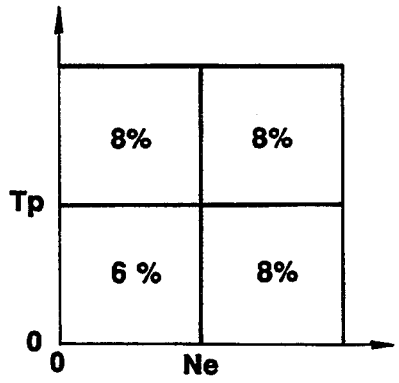
FIG. 6 is a characteristic graph for explaining a map value of another step component PL.

The step components PR and PL are derived using a table look-up technique from a map whose parameters are basic fuel injection pulsewidth Tp and engine revolution speed Ne (FIG. 5 shows a map of the step component PR and FIG. 6 shows a map of the step component PL).

It is noted that although the mapped values of PL and PR are different over a part of the engine driving condition regions in FIGS. 5 and 6, an average value of the air/fuel mixture ratio is maintained at the stoichiometric air/fuel mixture ratio even when the output responses of the oxygen concentration sensor are different at the time when the reverse to the rich side occurs and at the time when the reverse to the lean side occurs.

It is noted that the integration components IR and IL are given in proportion $\alpha$ to the fuel injection pulsewidth (engine load corresponding value) Tp as will be described later (steps S8 and S13 in FIG.3)

This is because in a region of engine driving condition wherein the control period of $\alpha$ becomes long, an amplitude of $\alpha$ becomes large so that the air/fuel mixture ratio falls out of the catalytic converter window and, therefore, the amplitude of $\alpha$ becomes substantially constant irrespective of the control period of $\alpha$. It is noted that the values of the integration components IR and IL may be equal to each other.

In this way, if the air/fuel mixture ratio of the exhaust gas is placed at the lean side with respect to the stoichiometric air/fuel mixture ratio, the injection quantity of fuel from the fuel injection valve 4 is increased to reach to the stoichiometric air/fuel mixture ratio. On the contrary, if the air/fuel mixture ratio is in the rich side, the fuel injection quantity from the fuel injection valve is reduced. These operations are repeated.

On the other hand, the learning area of the air/fuel mixture ratio is divided into a plurality of areas according to the fuel injection quantity Ne and engine revolution speed Tp. The learned value X of the air/fuel mixture ratio is allocated to each area.

Requirements to fall in the air/fuel mixture ratio learning are as follows:

(1) The engine revolution speed Ne and engine revolution speed Tp should fall into the same area.

(2) The control mode should be in a mode of the air/fuel mixture ratio feedback control:

(3) A difference between maximum and minimum values of the output voltage of the $O_2$ sensor should be above a constant value.

(4) An output of the $O_2$ sensor should have been sampled several times.

These all requirements are established to start the leaning of the air/fuel mixture ratio feedback correction coefficient (step S15 of FIG. 3).

A deviation variable $\epsilon$ from a center of control (1, 0) of $\epsilon$ is given by:

$$\epsilon=(\alpha_{MAX}+\alpha_{MIN})/2-1 \quad ①,$$

wherein $\alpha$ denotes a value of $\alpha$ immediately before the addition of PR.

$\alpha_{MIN}$ denotes a value of $\alpha$ immediately before the addition of $\alpha$ immediately before the addition of PL.

Using the deviation variable $\epsilon$, a learning value of the air/fuel mixture ratio is updated as appreciated from the following equation:

$$X=X+R\times\epsilon \quad ②$$

Provided that R : a rate of learning and updating per unit of time (below one).

Figure 7:
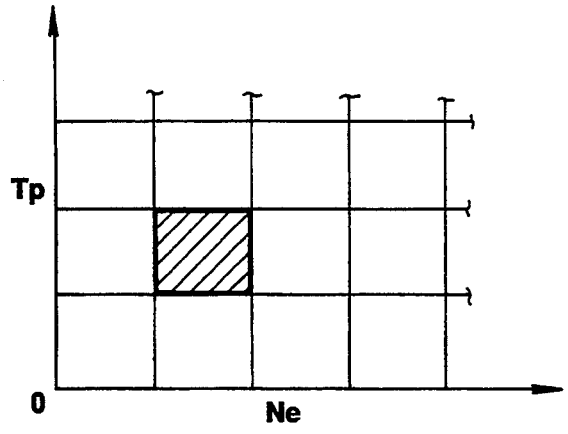
FIG. 7 is a characteristic graph for explaining a learning area of the air/fuel mixture ratio feedback correction coefficient ($\alpha$).

When the learning requirements are established, the area belonging to the outstanding Tp and Ne is selected from the map shown in FIG. 7 so as to read the learning value of that area. Thereafter, a value of X (X in a right side of the equation ②) to be retrieved by $\epsilon$ (therefore, X in a left side of the equation ② is stored newly into the same area (steps S15 through S18 of FIG. 3).

Furthermore, it is noted that even if a key switch is turned off, a battery backup is carried out so that the learning values of the learning area cannot be vanished or extinguished (volatile).

Figure 4:
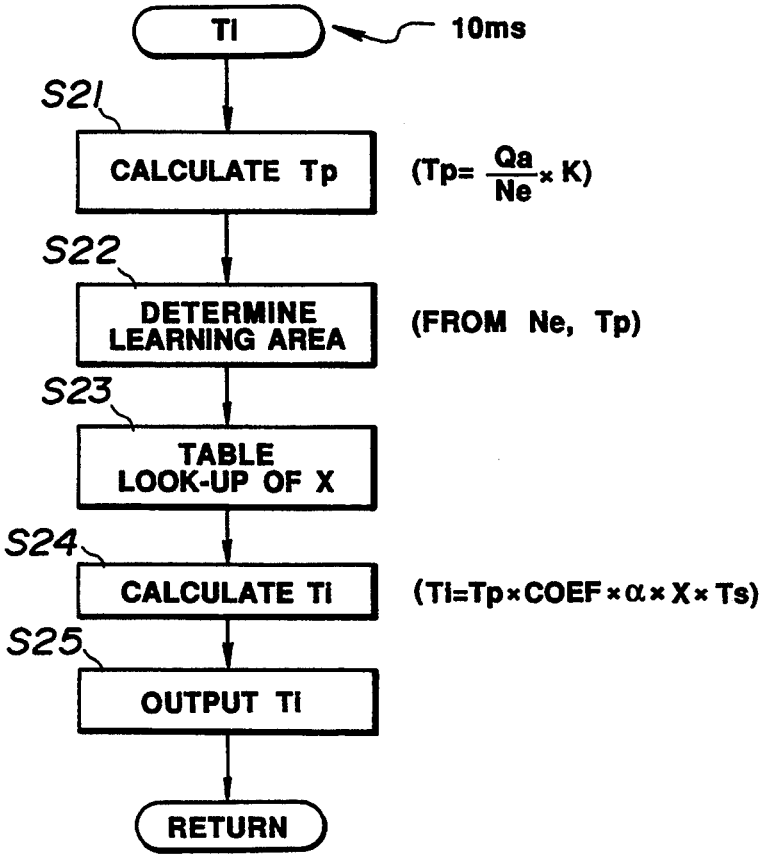
FIG. 4 is an operational flowchart for explaining a calculation of a fuel injection pulsewidth Ti.

On the other hand, the air/fuel mixture ratio learning value X is read when the fuel injection pulsewidth Ti is calculated as shown in FIG. 4.

$$Ti=Tp\times COEF\times\alpha\times X+Ts \quad ③$$

Provided that Tp: basic fuel injection pulsewidth; COEF: various correction coefficients; and Ts: ineffective pulsewidth.

The air/fuel mixture ratio learning value is effective for eliminating a steady error of the air/fuel mixture ratio. For example, variations in the flow characteristics of the airflow meter and fuel injection valve occur. Thereafter, if the variations due to aging effect occur, whenever the air/fuel mixture ratio feedback control mode is entered after the engine cranking, the air/fuel mixture ratio tends to be directed toward the rich side or lean side until the feedback control is advanced to some degree. On the other hand, if the air/fuel mixture ratio is carried out during a previous driving condition, the air/fuel mixture ratio learning value is acted upon as if the flow characteristics of the airflow meter and fuel injection valve were the same as those in the normalized condition.

In order to stabilize the engine revolution during the engine cold condition in which the fuel combustion is unstable, the air/fuel mixture ratio feedback control is halted so that the air/fuel mixture ratio is directed toward the richer air/fuel mixture ratio as compared with the stoichiometric air/fuel mixture ratio due to the increment of the fuel injection quantity according to the coolant temperature. When the surrounding catalytic converter gives a richer atmosphere due to the increment of the fuel injection quantity according to the coolant temperature, the conversion efficiencies of HC and CO are insufficient so that the secondary air is supplied to a part of the exhaust gas passage upstream of the oxygen concentration sensor to promote oxidations of HC and CO.

Figure 2:
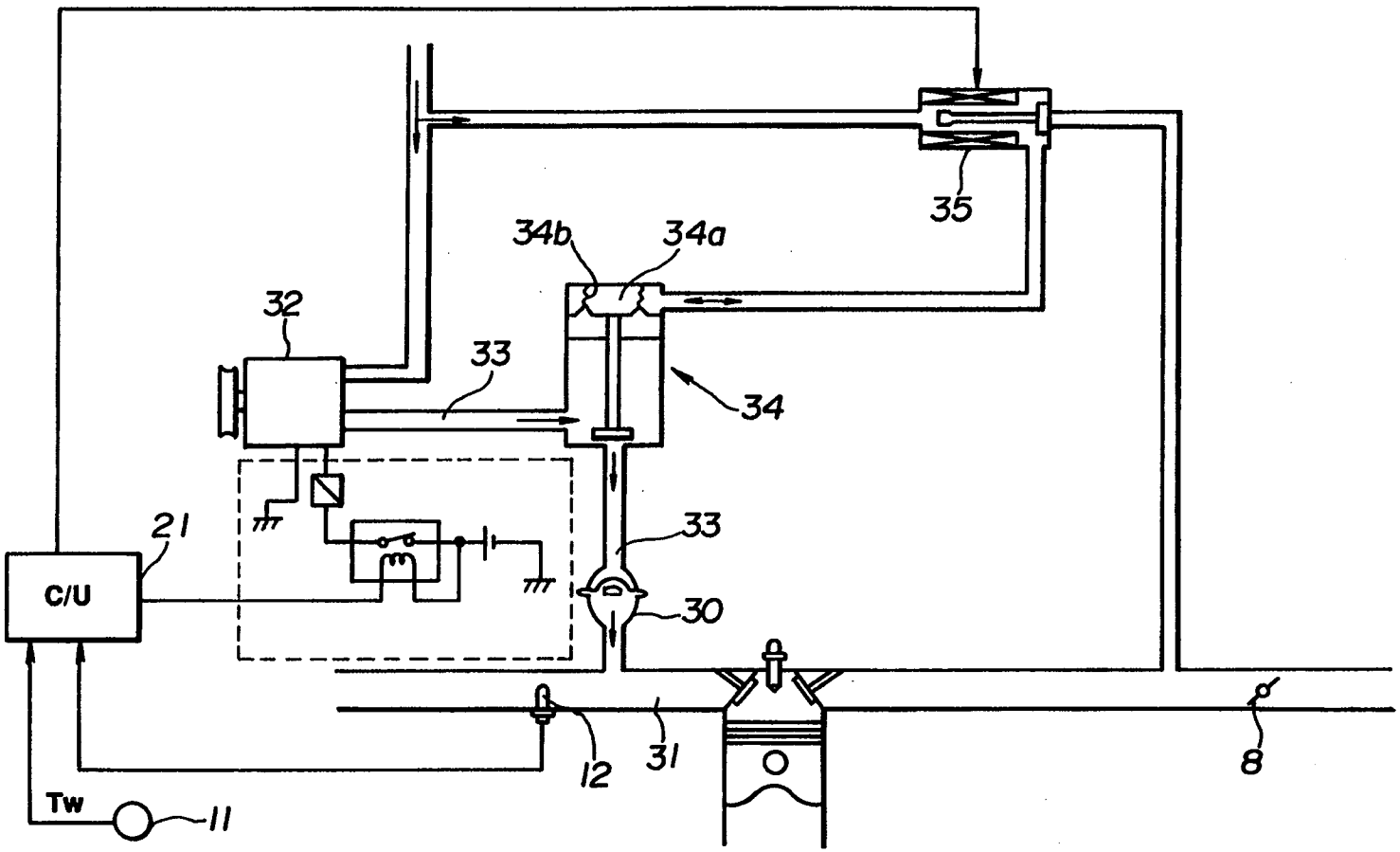
FIG. 2 is a system configuration of a secondary air supply apparatus attached to the internal combustion engine shown in FIG. 1.

FIG. 2 shows the secondary air supply apparatus.

The secondary air supply apparatus includes: a motor driven air pump 32; a secondary air passage 33 which serves to introduce the discharged secondary air from the air pump 32 into the part of the exhaust gas passage 31 upstream of the oxygen concentration sensor 12; a cut-out valve 34 interposed in a midway through the secondary air passage 33; and a solenoid valve 35 which selectively introduces either a negative pressure or atmospheric pressure into a working chamber of the cut-out valve 34. When ON signal is transmitted to the solenoid valve 35 to open the cut-out valve 34 against a biasing force of a spring **34*b*. A constant quantity of secondary air is introduced into the part of the exhaust gas passage 31 from the air pump 32. The secondary air is introduced so that the atmosphere around the air pump 32** gives the air/fuel mixture ratio near to the stoichiometric air/fuel mixture ratio so as to improve conversion efficiencies of HC and CO.

Figure 8:
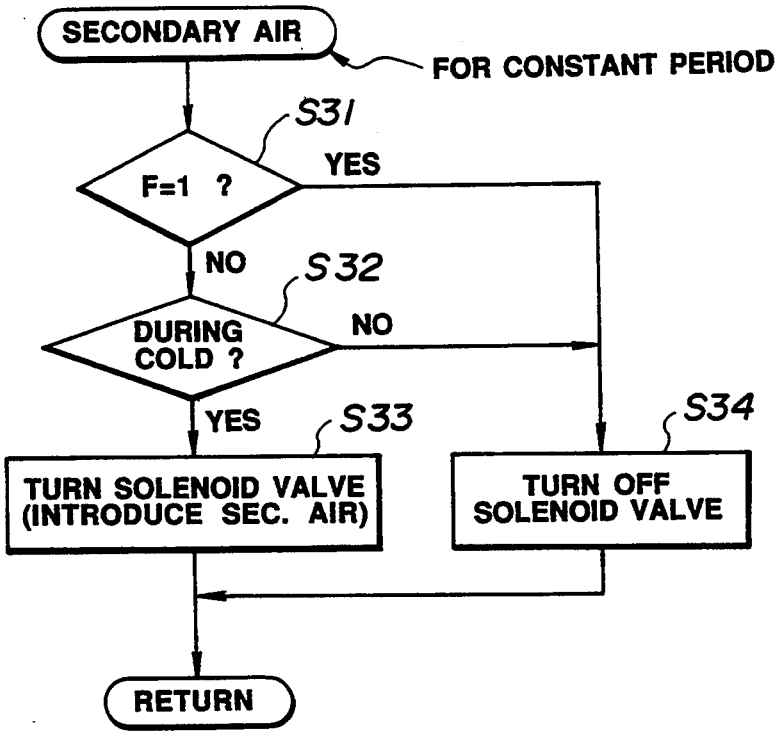
FIG. 8 is an operational flowchart for explaining a drive of a solenoid valve 35 shown in FIG. 2.

The control unit 21 outputs the ON signal to drive the solenoid valve 35 only if the engine falls in the cold condition (when the coolant temperature Tw is lower than a coolant temperature Twa during a complete warmed up state as shown in FIG. 8 (steps S32 and S33 of FIG. 8). It is noted that a flag F in FIG. 8 indicates whether the secondary air supply apparatus has failed. As far as no failure occurs, the routine shown in FIG. 8 advances to a step S32.

While the ON signal is output to the solenoid valve 35 in order to introduce the secondary air 35 into the part of the exhaust gas passage 31, the control unit 21 determines that the output signal of the oxygen concentration sensor indicates rich in the air/fuel mixture ratio and determines that a failure in the secondary air supply apparatus occurs. The control unit 21 sometimes erroneously determine the failure in the secondary air supply apparatus since the oxygen concentration sensor outputs the rich indicative signal other than the case where the secondary air supply apparatus has failed.

To cope with this problem, the control unit 21 carries out the air/fuel mixture ratio feedback control and carries simultaneously out the learning of the air/fuel mixture ratio during the introduction of the secondary air to the part of the exhaust gas passage.

At this time, the control unit 21 compares the derived learning value of the air/fuel mixture ratio with that derived during no introduction of the secondary air into the part of the exhaust gas passage so as to execute a diagnose the failure in the secondary air supply apparatus.

Figure 9:
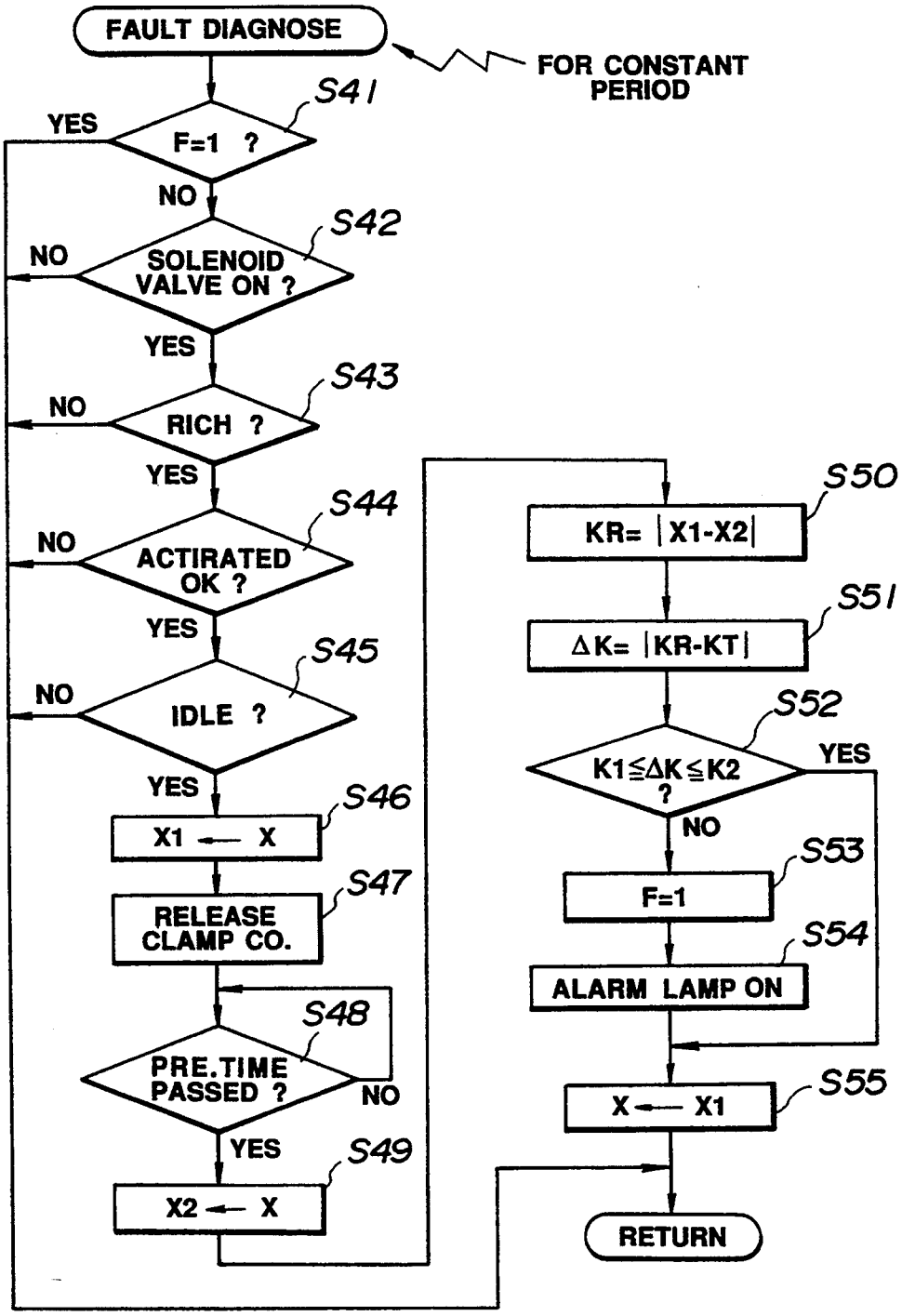
FIG. 9 is an operational flowchart for explaining a fault diagnostic routine in the preferred embodiment of the system for controlling the air/fuel mixture ratio shown in FIGS. 1 and 2.

FIG. 9 shows a flowchart executing a diagnose of the fault secondary air supply apparatus for a constant period of time.

The control unit 21 determines whether the following five conditions are established (Steps S41 to S45 of FIG. 9). After all five conditions are satisfied, the fault diagnose routine is entered.

①: $F\neq 1$ (step S41 of FIG. 9);

②: When the solenoid valve 35 is turned to ON (step S42 of FIG. 9):

③: When the output signal of the oxygen concentration sensor 12 indicates rich state with respect to the stoichiometric air/fuel mixture ratio (step S43 of FIG. 9);

④: When the oxygen concentration sensor 12 is activated (step S44 of FIG. 9);

⑤: When the engine falls in the idling condition (step S45 of FIG. 9).

Then, the conditions of ① and ② are the requirements when the secondary air is supplied to the part of exhaust gas passage 31. The reason of establishing condition ⑤ is that the engine is in the stable condition When entering the fault diagnose routine, the air/fuel mixture ratio learning value X is transferred into the memory X1 and the clamp condition of the air/fuel mixture ratio feedback control is released to enter the air/fuel mixture ratio (steps S46 and S47 of FIG. 9).

It is noted that the air/fuel mixture ratio learning value transferred to the memory X1 is a value backed up by means of the vehicle battery after the end of the previous driving of the engine, in other words, in a state where the secondary air is not introduced.

As soon as the entrance of the air/fuel mixture ratio feedback control, the leaning conditions are established so that the air/fuel mixture ratio learning values belonging to the learning area during the engine idling are updated (the learning is advanced). Therefore, as the predetermined time is elapsed, the outstanding air/fuel mixture ratio learning value X is transferred to another memory X2 (steps S48 and S49 of FIG. 9).

If a difference KR of both two memories X1 and X2 ($KR=|X1-X2|$) is derived at a step (S50 of FIG. 9), the difference corresponds to the secondary air flow quantity.

This is because the value of X2 appears an effect of the secondary air flow quantity in addition to the air flow quantity detected by the airflow meter and fuel injection quantity from the fuel injection valve 4 and the value of X1 appears only the effects by the airflow quantity detected by the airflow meter and fuel injection quantity of the fuel injection valve so that the difference is affected only by the secondary air flow quantity.

The difference of both memories KR should correspond to the value of the predetermined secondary air flow quantity. The value corresponding thereto is assumed to be a target value KT so that the difference between KR and KT should fall within a range of variations.

Therefore, to confirm whether a difference $\Delta K$ ($=|KR-KT|$ falls in the predetermined range ($K1 \leqq \Delta K \leqq K2$), the occurrence of failure can be determined if ($K1 \leqq \Delta K \leqq K2$) is not satisfied and the control unit 21 can set the flag F to 1 and can issue a command to turn on an alarm lamp installed near a driver's seat of the vehicle body (steps S51, S52, S53, and S54 of FIG. 9). After $F=1$, the introduction of the secondary air is inhibited (steps S31 and S34 of FIG. 8). If ($K1 \leqq \Delta K \leqq K2$) is satisfied, the routine jumps over steps S53 and S54.

Finally, the value of memory X1 is returned to the learning area belonging to the engine idling (step S55 of FIG. 9). This is because after the fault diagnose is ended, the memory state is returned to the original.

An action of the preferred embodiment described above will be explained below.

The air/fuel mixture ratio in the exhaust gas during the introduction of the secondary air is affected not only by the flow quantity characteristic of the secondary air supply apparatus but also by the combination of the flow characteristics of fuel injection valve and airflow meter.

For example, 1) due to variations in products during the manufactures thereof and due to the aging effects thereafter, the airflow meter detects the intake air quantity which is larger than the actual intake air quantity and flow quantity of fuel injection through the fuel injection valve is deviated from the real fuel injection quantity toward a larger value so that the fuel quantity supplied to the engine is increased. Therefore, even if the flow quantity of secondary air is appropriate, the air/fuel mixture is relatively rich. On the contrary, 2) when due to a failure in the air pump and, therefore, flow quantity of the secondary air becomes insufficient, the airflow meter detects the intake air quantity which is less than the actual intake air quantity and fuel injection valve injects fuel whose amount is less than the real fuel injection quantity, the air/fuel mixture ratio becomes slightly lean or becomes maintained at the stoichiometric air/fuel mixture ratio.

In these cases, as the previously proposed air/fuel mixture ratio control apparatus described in the BACKGROUND OF THE INVENTION tends to determine the failure in the secondary air supply apparatus according to the air/fuel mixture ratio signal of the oxygen sensor during the introduction of the secondary air, the control apparatus erroneously determine the failure in the secondary air supply apparatus when the case 1) appears since the secondary air supply apparatus does not fail and erroneously determine no failure in the secondary air supply apparatus when the case 2) appears since the secondary air supply apparatus actually fails.

In the cases of 1) and 2) wherein the air/fuel mixture ratio learning control is carried out during the introduction of secondary air, the learning value derived during the introduction of secondary air is affected by the secondary air supply quantity from the secondary air supply apparatus and by the combination of air flow quantity detected by the airflow meter and fuel injection quantity from the fuel injection valve. In this case, no separation of both effects cannot be made.

On the other hand, the learning value of the air/fuel mixture ratio derived during no introduction of secondary air, of course, is affected only by the combination of airflow quantity detected by the airflow meter and fuel injection quantity from the fuel injection valve.

Hence, if the difference between both learning values of the air/fuel mixture ratios KR is derived, the difference KR represents only effect by the secondary airflow quantity from the secondary air supply apparatus. If no failure occurs in the secondary air supply apparatus, the difference KR should be settled at the target value KT corresponding to the secondary air flow quantity when no failure occurs in the secondary air supply apparatus.

As a practical matter of fact, the secondary air flow quantity has variations. Correspondingly to such variations, the difference $\Delta K$ ($=|KR-KT|$) from the target value KT has variations in the predetermined range. Therefore, if the upper limit and lower limit of the variation range are defined as a upper limit value K2 and as a lower limit K1, respectively, the control apparatus correctly determine no failure in the secondary air supply apparatus when $K1 \leqq \Delta K \leqq K2$.

In other words, if the secondary air flow quantity is reduced due to failures in the air pump 32 and/or solenoid valve 35, $\Delta K$ becomes lower than the lower limit value K1 of the variation range and if the secondary air flow quantity is increased, $\Delta K$ becomes higher than the upper limit value K2. In theses cases, the control apparatus in the preferred embodiment can determine the occurrence in failure in the secondary air supply apparatus.

In this way, the comparison of the learning values of the air/fuel mixture ratio derived respectively from the cases wherein the secondary air is introduced and wherein no secondary air is introduced means the fault diagnose of the secondary air supply apparatus so that the examples of 1) and 2) can clearly be distinguished from each other and the control apparatus cannot erroneously determine the failure in the secondary air supply apparatus.

Although the control apparatus in the preferred embodiment executes the fault diagnose during the engine idling, the fault diagnose can be carried out when the engine falls in a constant driving condition continued for a predetermined period of time.

Figure 10:
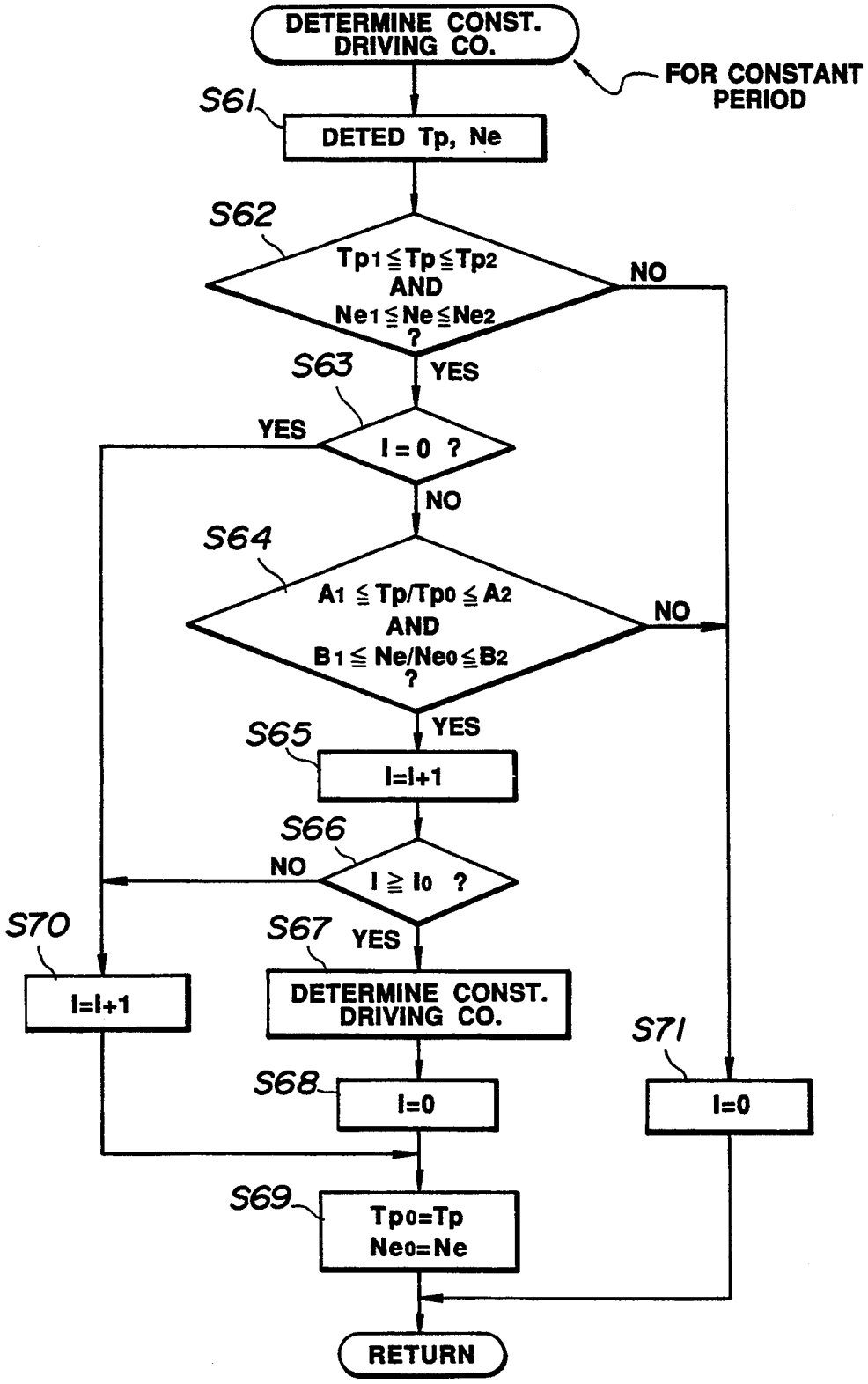
FIG. 10 is an operational flowchart for explaining a determination of a constant driving condition of the engine continued for a predetermined period of time in a case of another preferred embodiment of the system for controlling the air/fuel mixture ratio.

FIG. 10 shows an operational flowchart of executing the fault diagnose during the constant engine driving condition described above.

At steps S61 and S62, the control unit 21 determines whether both present basic fuel injection pulsewidth Tp and engine revolution speed Ne fall in predetermined ranges, respectively (for Tp, $Tp_1 \leqq Tp_2$, for Ne, $Ne_1 \leqq Ne_2$).

When both Tp and Ne first fall in the predetermined ranges, respectively, the value of counter I is incremented to measure the elapsed time duration. The present values of Tp and Ne are stored as reference values $Tp_0$ and $Ne_0$ (steps S62, S63, S70, and S69 of FIG. 10).

If neither Tp nor Ne falls in the predetermined ranges at the first time, i.e., both Tp and Ne continuously fall in the predetermined ranges, the control unit determines whether both ratios of the values of the previous Tp and Ne, i.e., reference values $Tp_0$ and $Ne_0$ are in the predetermined ranges (for $Tp/Tp_0$, $A_1 \leqq Tp/Tp_0 \leqq A_2$, for $Ne/Ne_0$, $B_1 \leqq Ne/Ne_0 \leqq_2$) (steps S63 and S64 of FIG. 10).

If neither ratios fall in the predetermined ranges, the control unit 21 determines that the engine falls in the transient state (acceleration or deceleration) and the value of counter I is cleared to end the present routine (steps S64 and S71 of FIG. 10). It is noted that the lower limit values of $A_2$ and $B_2$ denote a value slightly lower than 1 and upper limit values of $A_1$ and $B_1$ denote a value slightly higher than 1.

If the engine is determined not to fall in the transient condition, the increment of the counter value I is continued to reach I to a predetermined value $I_0$ and the control unit 21 determines that the engine falls in the constant driving condition for the predetermined period of time (steps S64, S65, S66, and S67 of FIG. 10).

Next, to prepare the subsequent fault diagnose, the value of the counter I is cleared and the present Tp and Ne are stored as the reference values $Tp_0$ and $Ne_0$ at steps S68 and S69 of FIG. 10. While $I < I_0$, the continuation of increment of the counter value I and storage of the present values of Tp and Ne as the reference values $Tp_0$ and $Ne_0$ are repeated at steps S66, S70, and S69 of FIG. 10.

Figure 11:
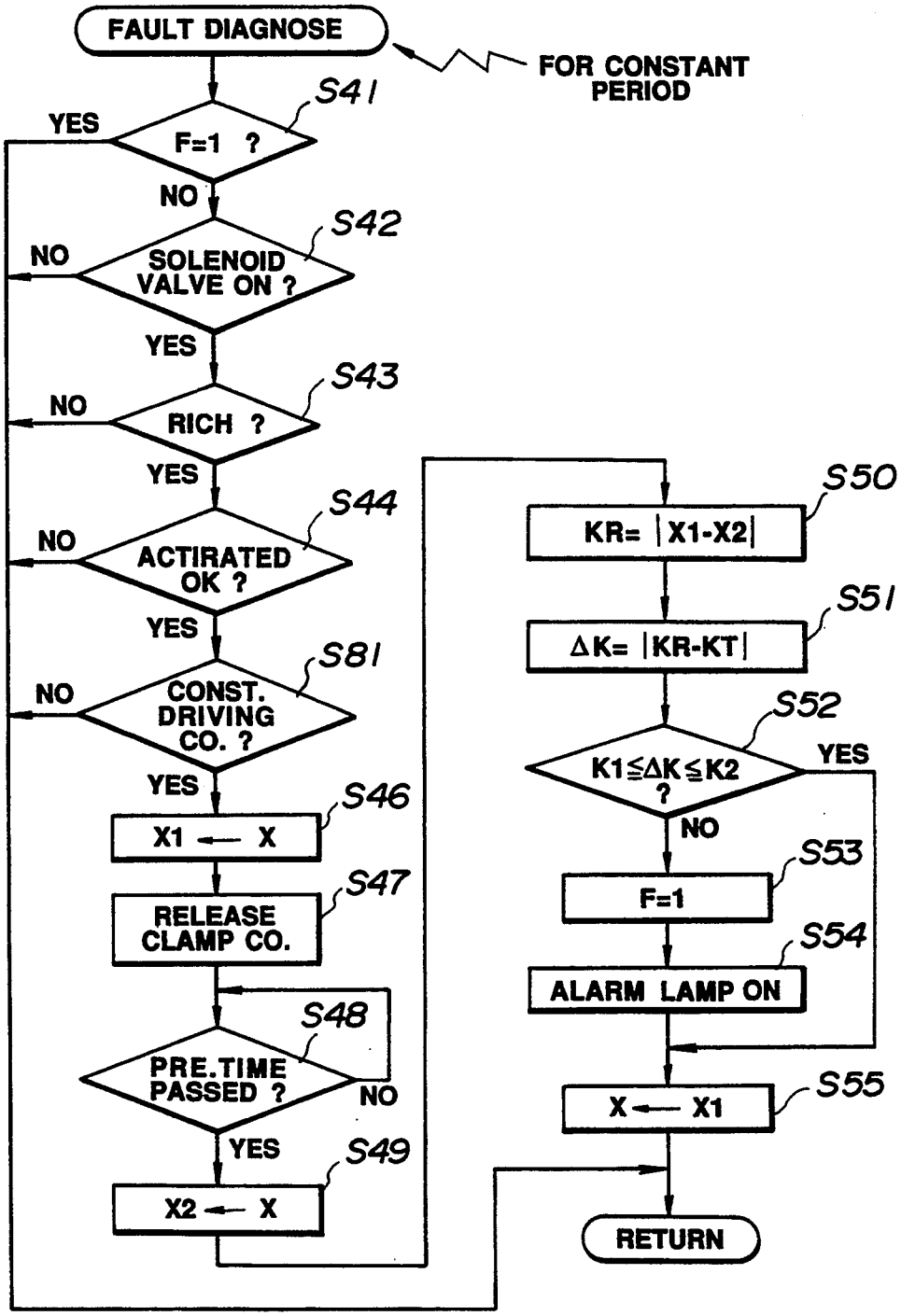
FIG. 11 is an operational flowchart for explaining a fault diagnose of the other preferred embodiment according to the present invention.

On the other hand, in the flowchart shown in FIG. 11, the condition such that the engine falls in the constant driving condition for the predetermined period of time is a requirement of entering the fault diagnose at a step S81 in FIG. 11.

It is noted that at the step S46 the learning value of X of the air/fuel mixture ratio which enters the learning area belonging to the constant driving condition is transferred to X1 of the memory and at the step S55 the value of memory X1 is returned to the learning area belonging to the constant driving condition.

As described hereinabove, in the air/fuel mixture ratio control apparatus according to the present invention the secondary air supply apparatus is installed so that the secondary air is introduced into the part of exhaust gas passage upstream of the oxygen concentration sensor, memories which respectively stores the learned values of the air/fuel mixture ratio during introduction of the secondary air and during no introduction of secondary air are prepared, the control apparatus carries out the air/fuel mixture ratio feedback control on the basis of the output signal of the oxygen concentration sensor respectively during the introduction or no introduction of the secondary air, and updates the air/fuel mixture ratio learning values stored in the corresponding memories, the learning values are compared with each other to diagnose the failure in the secondary air supply apparatus.

Therefore, even if the flow quantity characteristics of the airflow meter and fuel injection valves have variations and aging effects are generated thereafter, an accurate determination of the fault secondary air supply apparatus can be made.

It is noted that although in the preferred embodiment, the secondary air is introduced to the engine during a cold interval of the engine, the seconary air may be supplied under any engine operation condition except the engine cold condition.

It will fully be appreciated by those skilled in the art that the foregoing description has been made in terms of the preferred embodiment and various changes and modifications may be made without departing from the scope of the present invention which is to be defined by the appended claims.

What is claimed is:

1. An apparatus for an internal combustion engine, comprising:

a) an oxygen concentration sensor disposed in an exhaust gas passage of the engine upstream of a catalytic converter for detecting and outputting a signal indicative of an air/fuel mixture ratio of the engine;

b) a secondary air supply apparatus disposed in the engine and which is constructed so as to supply a secondary air to the exhaust gas passage upstream of said oxygen concentration sensor;

c) first means for determining whether said secondary air supply apparatus is operated to supply the secondary air to the exhaust gas passage;

d) second means for controlling out an air/fuel mixture ratio of the engine in a feedback control mode on the basis of the signal derived from said oxygen concentration sensor during the supply of the secondary air determined as the result of determination by said first means, deriving a feedback correction coefficient of the air/fuel mixture ratio as the result of the feedback control thereby and updating an air/fuel mixture ratio learning value stored in a first memory on the basis of the -feedback correction coefficient derived thereby;

e) third means for controlling the air/fuel mixture ratio of the engine in the feedback control mode on the basis of the signal derived from said oxygen concentration sensor during no supply of the secondary air determined as the result of determination by said first means, deriving the feedback correction coefficient of the air/fuel mixture ratio as the result of the feedback control thereby and updating the air/fuel mixture ratio learning value stored in a second memory on the basis of the feedback correction coefficient derived thereby; and f) fourth means for comparing both updated values in said first and second memories to carry out a diagnostic for the secondary air supply apparatus.

2. An apparatus for an internal combustion engine as set forth in claim 1, wherein said fourth means includes fifth means for determining whether an absolute difference ΔK) between a difference (KR) between both learning values (X1 and X2) and a target value (KT) falls in a predetermined range ($K1 \leqq \Delta K \leqq K2$) and sixth means for determining and displaying a failure of the secondary air supply apparatus according to the result of determination that the absolute difference falls out of the predetermined range.

3. An apparatus for an internal combustion engine as set forth in claim 2, wherein said sixth means turns an alarm lamp installed in a vehicle in which the engine is mounted when the failure of the secondary air supply apparatus is determined to occur.

4. An apparatus for an internal combustion engine as set forth in claim 3, wherein said sixth means sets a flag (F) to one when the failure of the secondary air supply apparatus is determined to occur.

5. An apparatus for an internal combustion engine as set forth in claim 3, wherein said fourth means carries out the fault diagnose of the secondary air supply apparatus when all of the following conditions are established:

(1); $F \neq 1$, (2); when a solenoid valve installed in a secondary air passage of the secondary air supply apparatus is turned on, (3); when an output signal of said oxygen concentration sensor indicates a rich air/fuel mixture ratio, (4); when said oxygen concentration sensor is activated, and (5); when the engine falls in an idling condition.

6. An apparatus for an internal combustion engine as set forth in claim 5, wherein when all of the conditions are established, the learning value X of the air/fuel mixture ratio entering a learning area belonging to the engine idling condition is transferred to the memory X1 and the fourth means enters the air/fuel mixture ratio feedback control releasing a clamp condition of the air/fuel mixture ratio feedback control. The air/fuel mixture ratio learning value stored in the memory X1 being a value backed up by means of a vehicle battery from a previous same driving condition.

7. An apparatus for an internal combustion engine as set forth in claim 6, wherein when a learning condition is established after a predetermined period of time upon the entrance of the air/fuel mixture ratio feedback control, the learning value in the learning area belonging to the engine idling condition is updated and the present learning value is transferred to the other memory X2 and wherein said fifth means derives the difference between learning values of two memories as KR ($KR = |X1 - X2|$) and the difference ΔK ($\Delta K = |KR - KT|$.

8. An apparatus for an internal combustion engine as set forth in claim 7, wherein after $F = 1$, the introduction of the secondary air to the exhaust gas passage is inhibited.

9. An apparatus for an internal combustion engine as set forth in claim 3, wherein said fourth means carries out the fault diagnose of the secondary air supply apparatus when all of the following conditions are established:

(1); $F \neq 1$, (2); when a solenoid valve installed in a secondary air passage of the secondary air supply apparatus is turned on, (3); when an output signal of said oxygen concentration sensor indicates a rich air/fuel mixture ratio, (4); when said oxygen concentration sensor is activated, and (5); when the engine falls in a constant driving condition for a predetermined period of time.

10. An apparatus for an internal combustion engine as set forth in claim 9, wherein said second means includes an airflow meter which is so constructed as to detect the intake air quantity of the engine and output a signal indicative of the intake air quantity, a sensor which is so constructed as to detect the engine revolution speed and output a signal indicative of the engine revolution speed, and calculation means for calculating a basic pulsewidth Tp on the basis of the intake air quantity derived by the airflow meter and detected engine revolution speed Ne and wherein the learning condition that the constant driving condition is continued for the predetermined period of time is established when the conditions that $Tp_1 \leqq Tp \leqq Tp_2$ and $Ne_1 \leqq Ne \leqq Ne_2$ and $A_1 \leqq Tp/Tpo \leqq A_2$ and $B_1 \leqq Ne/Neo \leqq B_2$ are continued for the predetermined period of time ($I_0$) measured by a counter I, wherein $Tp_1$, $Ne_1$, $A_1$, and $B_1$ denote lower limit values for the respective basic pulsewidth Tp, engine revolution speed Ne, a ratio between Tp and a reference value of Tpo, and a ratio between Ne and, a reference value of Neo and $Tp_2$, $Ne_2$, $A_2$, and $B_2$ denote upper limit values for the respective basic pulsewidth Tp, engine revolution speed Ne, the ratio of Tp/Tpo, and the ratio of Ne/Neo.

11. A method for diagnosing a secondary air supply apparatus for an internal combustion engine, said internal combustion engine having a)

a) an oxygen concentration sensor disposed in an exhaust gas passage of the engine upstream of a catalytic converter for detecting and outputting a signal indicative of an air/fuel mixture ratio of the engine; and b) the secondary air supply apparatus disposed in the engine and which is constructed so as to supply a secondary air to the exhaust gas passage upstream of said oxygen concentration sensor; said method comprising the steps of:

c) determining whether said secondary air supply apparatus is operated to supply the secondary air to the exhaust gas passage;

d) controlling an air/fuel mixture ratio of the engine in a feedback control mode on the basis of the signal derived from said oxygen concentration sensor during the supply of the secondary air determined as the result of determination by said first means, deriving a feedback correction coefficient of the air/fuel mixture ratio as the result of the feedback control therein and updating an air/fuel mixture ratio learning value stored in a first, memory on the basis of the feedback correction coefficient derived therein;

e) controlling the air/fuel mixture ratio of the engine in the feedback control mode on the basis of the signal derived from said oxygen concentration sensor during no supply of the secondary air determined as the result of determination by said first means, deriving the feedback correction coefficient of the air/fuel mixture ratio as the result of the feedback control therein and updating the air/fuel mixture ratio learning value stored in a second memory on the basis of the feedback correction coefficient derived therein; and f) comparing both updated values in said first and second memories to carry out a diagnostic for the secondary air supply apparatus to determine whether the secondary air supply apparatus has failed.

* * * * *